United States Patent [19]

Chambers et al.

[11] Patent Number: 4,984,713

[45] Date of Patent: Jan. 15, 1991

[54] CARBONATED BEVERAGE DISPENSER

[76] Inventors: Gary C. Chambers, Box 157, Rt. 79, Burdett, N.Y. 14818; Ernest E. Brand, Jr., R.D. #3, Box 204, Corning, N.Y. 14830

[21] Appl. No.: 32,241

[22] Filed: Mar. 31, 1987

[51] Int. Cl.[5] ..... B65D 35/56

[52] U.S. Cl. ..... 222/105; 222/143; 222/386.5

[58] Field of Search ..... 222/105, 183, 386.5, 222/173, 181, 185, 143; 215/12 A, 12 R, 11.3, 11.5, 10; 220/403, 404, 410; 248/DIG. 11, 346

[56] References Cited

U.S. PATENT DOCUMENTS

| | | | |
|---|---|---|---|
| 2,338,604 | 1/1944 | Silveyra | 220/404 X |
| 3,151,785 | 10/1964 | Scarpa | 222/185 X |
| 3,158,296 | 11/1964 | Cornelius | 222/386.5 |
| 3,198,390 | 8/1965 | Beckman et al. | 222/105 |
| 3,206,054 | 9/1965 | Militello | 215/11.3 |
| 4,330,066 | 5/1982 | Berliner | 215/1 |
| 4,671,428 | 6/1987 | Spatz | 222/105 |
| 4,722,463 | 2/1988 | Anderson | 222/185 |

*Primary Examiner*—H. Grant Skaggs
*Assistant Examiner*—Dean A. Reichard

[57] ABSTRACT

A receptacle in which a collapsible fluid-holding container is disposed within an outer rigid container. The collapsible container comprises a flexible bag and a mouthpiece that is joined to the mouth of the rigid container. A valve in the outer container at a region distal from the mouth vents the region between the containers to enable the collapsible container to be filled with liquid. The valve also admits air between the containers to enable the inner container to collapse as fluid is dispensed. A pair of feet protrude laterally from one side of the receptacle to raise the bottom of the receptacle when it is horizontally disposed in a fluid-dispensing position. A method is disclosed for evacuating the outer container to facilitate the expansion of a collapsed flexible container.

7 Claims, 3 Drawing Sheets

CARBONATED BEVERAGE DISPENSER

BACKGROUND OF THE INVENTION

This invention relates to a container for pressurized liquid such as carbonated beverage and more particularly to such a container having a flexible inner bag.

Gassed liquid products such as beer in the keg contain a substantial amount of gas, such as carbon dioxide, dissolved in the liquid. This liquid is kept under pressure within a pressure resistant vessel to keep the liquid product from going flat due to outgassing of carbon dioxide and exposure of the liquid to air. In commercial establishments which dispense such carbonated beverages, carbon dioxide or the like is supplied to the container through pressure-regulated tanks of gas. The complexity and size of such a system is such as to render it uneconomical for home dispensing.

"Bag-in-box" containers are used to prevent air from contacting non-pressurized liquids such as still wine while it is being stored and dispensed. Such a container consists of a substantially impermeable bag, usually of metallized polyethylene, disposed within a box of cardboard or similar material, the bag being filled with wine and having a tap projecting through the box material so that the wine can be easily dispensed. The great advantage of such a container over a conventional bottle, carafe or the like is that the bag is made of flexible material so that as liquid is dispensed, the bag collapses by a corresponding amount, and no air is allowed to enter to cause oxidation of the liquid. Accordingly the bag-in-box packaging keeps the product fresh for an extended period.

Attempts have been made to extend bag-in-box packaging to pressurized liquids, particularly carbonated beverages such as beer and soft drinks, so as to achieve, in relation to these liquids, the above-mentioned advantages. However, when such liquids are filled into flexible bags within semi-rigid casings in the form of boxes, the latter have been found to bulge outwardly because of the pressure within the liquid. This is clearly unsatisfactory as it makes the overall container unstable. Perhaps low carbonated beverages such as low carbonated beer and lightly carbonated wine coolers can be packaged in conventional bag-in-box containers if they are well constructed and carefully handled; however, present day fully carbonated beverages, which can generate pressures on the order of 90 psi, cannot be packaged therein.

There is disclosed in U.S. Pat. No. 4,330,066 (R. Berliner) a liquid receptacle in which a collapsible fluid-holding container is disposed within an outer bottle of substantially fixed shape. Unlike the box of the bag-in-box container, the outer bottle has no cracks or crevices to permit the entry of venting air between the flexible bag and the bottle as liquid is dispensed from the flexible bag. The Berliner patent teaches that the flexible bag is secured by adhesive to the bottom wall of the bottle. To vent air to the space between the flexible bag and the bottle, a plurality of apertures are formed through the thread-forming convolutions on the bottle neck. The inner container mouthpiece contains a plurality of spaced flanges which extend outwardly to snap into an annular recess formed on the inner surface of the bottle mouth. The venting air flows through the apertures and between the flanges to the air space between the collapsible bag and the bottle. A liquid receptacle having such a venting system is difficult to form and is therefore relatively expensive since venting apertures have to be formed radially through the bottle neck, and the flange-receiving annular recess must be formed on the inner surface of the bottle mouth making conventional blow forming techniques impractical. Furthermore, conventional caps are not formed to sufficiently high tolerances to seal the apertures, especially after the cap has been initially opened. This incomplete sealing can enable the flexible bag to extrude through the venting space between the flanges. Such extrusion can lead to rupture of the flexible bag and consequently to contamination of the carbonated beverage by air, whereby the beverage quickly goes flat.

SUMMARY OF THE INVENTION

It is therefore an object of the present invention to provide a bag-in-bottle receptacle having an inexpensive and simply constructed air vent that does not permit extrusion of the flexible bag therethrough even when high pressure builds up therein. Another object is to provide an improved method of inserting the inner, flexible container into the outer container. Yet another object is to provide an improved bottle base which facilitates the dispensing of liquid from the bottle.

The receptacle of the present invention comprises an outer container of substantially fixed shape formed with a mouth at one end thereof. An inner container which is disposed within the outer container is formed with a mouthpiece of substantially fixed shape. At least a portion of the mouthpiece is disposed at the mouth of the outer container, and at least a major portion of the inner container is collapsible. The mouthpiece of the inner container can be adhered to the mouth of the outer container. Venting means is located along the outer container at a region distal from the mouth for admitting air between the inner and outer containers to permit collapse of the inner container when fluid is poured therefrom. Means is provided for preventing extrusion of the inner container through the venting means when pressure builds up in the inner container.

The venting means comprises an aperture in the bottom of the outer container. A cover over the inner surface of the aperture prevents extrusion of the inner container through the aperture. The cover may take the form of a thickened region at the bottom of the inner container or a strip adhered to the inner surface of the outer container.

The receptacle can include a base having at least one projection extending laterally of the outer container to raise the bottom thereof when the receptacle is disposed in a horizontal, fluid-dispensing position. The base preferably comprises two spaced projections protruding from one side of the outer container. The distance between the outer portions of the projections is about the same as the outer diameter of the outer container.

Insertion of the inner container into the outer container can be facilitated by the following method. A tube is inserted through the mouthpiece of the inner container and into the flexible bag. A source of low pressure is connected to the tube to collapse the bag around the tube. After the tube and bag are inserted through the mouth of the outer container, the source of low pressure is disconnected from the tube. The flexible bag is then expanded within the outer container. This can be accomplished by applying positive pressure to the tube. If the mouth of the outer container is not sealed to the mouthpiece of the inner container, air from within the outer container can exhaust through that gap during the step of expanding the flexible bag. The expansion of the bag can be accomplished by evacuating air from the outer container through the aperture in the bottom thereof. A rod can be inserted through the aperture to ensure that it is free from obstruction while the outer container is being evacuated.

DESCRIPTION OF THE PREFERRED EMBODIMENTS

Figure 1:
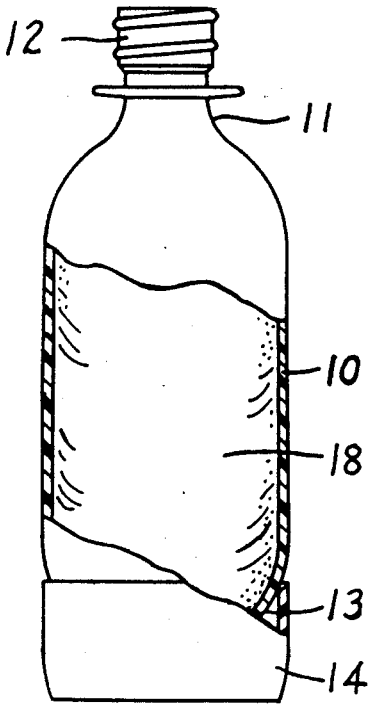
FIG. 1 is an elevational, partially cut-away view of a receptacle in accordance with the present invention, in which a flexible bag is disposed within a bottle which is of substantially fixed shape and which is capable of withstanding pressure.

As shown in FIG. 1, the receptacle of the present invention includes a bottle 10 having a substantially fixed shape formed with a neck 11. The mouth is closed by cap 12. The bottom portion 13 of bottle 10 is spherically shaped in order to withstand a maximum amount of pressure. Base member 14, which may be of conventional design, is bonded to the rounded bottom 13 by adhesive. Bottle 10 contains a collapsible container including a flexible bag 18 which, when filled with liquid, completely fills the inside of bottle 10.

Flexible bag 18 can be formed of any suitable collapsible material such as polyethylene, flexible polypropylene, or the like, or it can be formed of a rubbery material. Bag 18 could also be formed of a plurality of layers. For example, it could comprise an inner layer of a material such as polyethylene and an outer covering of nylon/aluminum/polysolefin laminate. The latter mentioned material is effective in preventing the ingress of oxygen into the bag and preventing escape of carbon dioxide from the carbonated liquid.

Figure 2:
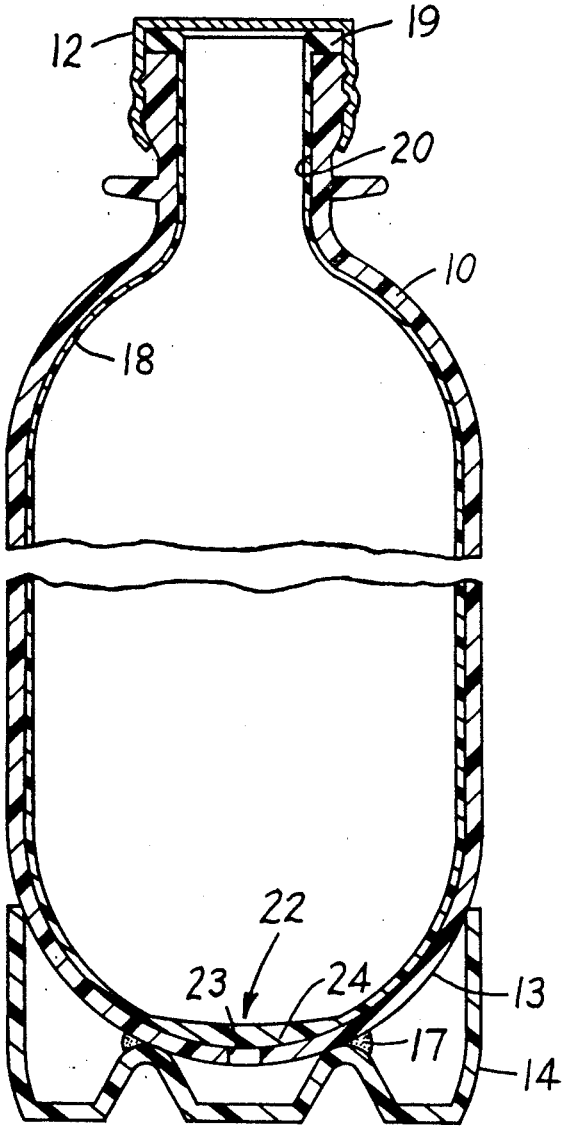
FIG. 2 is a cross-sectional view of one embodiment of the invention.

A first type of inner container is illustrated in FIG. 2. Flexible bag 18 is of the type which is blow formed in a mold to the same shape as the inside of bottle 10. In some cases the same mold may be used to form both bottle 10 and bag 18. The inner container must be provided with a mouthpiece for joining it with the mouth of the outer container. In FIG. 2 the mouthpiece is a pressure formed rim 19 which has a thicker cross-section than bag 18, but the inner dimension of the two are the same. The rim opening is chamfered, and the outer circumference thereof extends over the open portion of mouth 20.

If the liquid within bag 18 is to be poured from the bottle, it is preferred that rim 19 be secured in the position illustrated in FIG. 2. To accomplish this purpose, rim 19 could be adhesive bonded to the end of mouth 20, or the rim could be provided with a shoulder (to be described below) which frictionally engages the inner surface of mouth 20.

Figure 10:
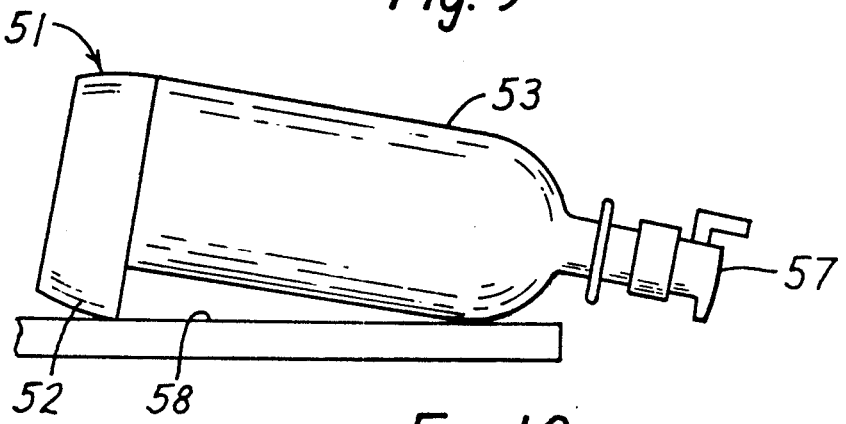
FIG. 10 illustrates the function of the improved bottles of FIGS. 8 and 9.

If a liquid dispensing device such as a tap or the like is to be affixed to mouth 20 to dispense liquid in the manner illustrated in FIG. 10, rim 19 is forced against the end of mouth 20 when the tap is screwed thereon. In such an embodiment rim 19 does not have to be tightly secured to the end of mouth 20.

In accordance with the present invention the bottom of bottle 10 is provided with an antiextrusion valve 22 comprising an aperture 23 which is completely covered by the thick bottom portion 24 of bag 18. For example, if aperture 23 were about 3/16 inch in diameter, thick portion 24 could be about ½ inch in diameter. Portion 24 must be sufficiently thick that it will not extrude through aperture 23 when the pressure within flexible bag 18 builds up.

Figure 4:
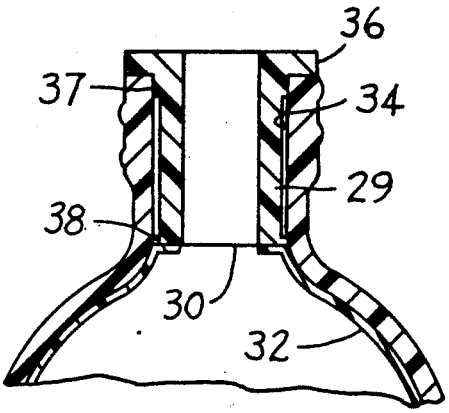
FIG. 4 is a cross-sectional view of the top portion of a bottle employing a bag formed from the pattern of FIG. 3.
Figure 3:
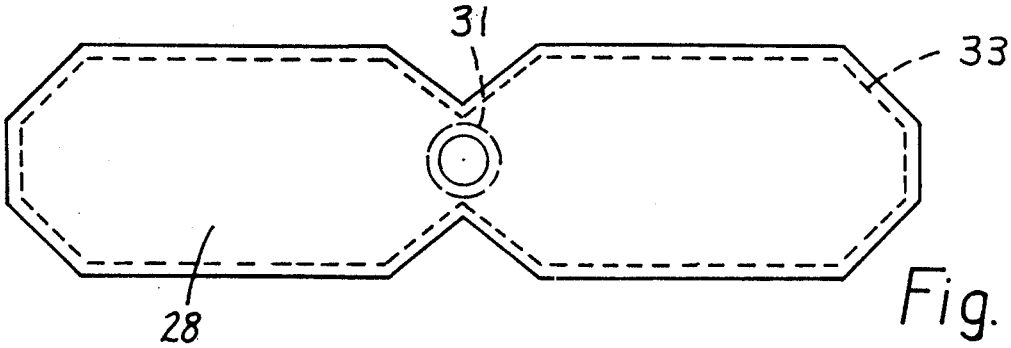
FIG. 3 shows a pattern which can be used to form a flexible bag.

FIGS. 3 and 4 illustrate another type of flexible bag which may be employed. The flexible bag can be formed from a sheet 28 of flexible material cut to the pattern illustrated in FIG. 3. A relatively rigid mouthpiece 29 is provided with an annular flat region 30 which is secured to sheet 28 by means of heat sealing or adhesive so that the periphery of region 30 is aligned with dashed line circle 31. A liquid tight flexible bag 32 is then formed by folding sheet 28 so that the two halves thereof become superimposed, thereby permitting the peripheral regions of the two halves to be joined in the vicinity of dashed line 33 by means such as heat sealing or adhesive. Mouthpiece 29 is formed with an annular rim 36, the under surface of which contains an annular groove forming a shoulder 37 which fits within the end of mouth 34 of bottle 35. The outer circumference of rim 36 extends over the open portion of mouth 34.

To secure mouthpiece 29 in the position illustrated in FIG. 4, rim 36 could be adhesive bonded to the end of mouth 34, or shoulder 37 could frictionally engage the inner surface of mouth 34. Alternatively, at least a portion of the outer diameter of mouthpiece 29 could be sufficiently great that it forms a protrusion 38 which extends to and frictionally engages mouth 34.

Figure 5:
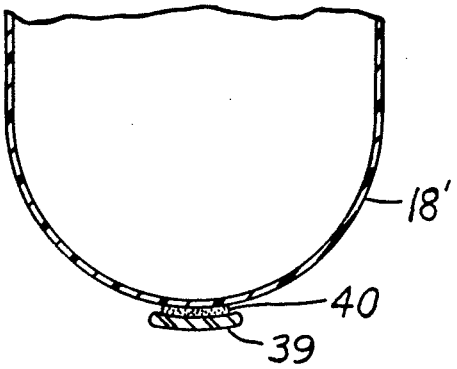
FIG. 5 is a cross-sectional view of the bottom of a modified flexible bag.
Figure 6:
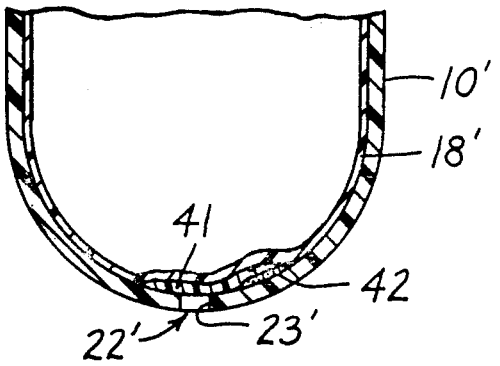
FIG. 6 is a cross-sectional view of the bottom of a bottle having an antiextrusion valve formed therein.

In the embodiments illustrated in FIGS. 5 and 6 elements corresponding to those illustrated in FIG. 2 are represented by primed reference numerals. Flexible bag 18' of FIG. 5 is of the type which can be blown or molded to the shape of bottle 10. A strip 39 of plastic, rubber, metal or the like is adhered to the bottom of bag 18' by adhesive 40. Strip 39 is preferably round in shape.

In the embodiment of FIG. 6 valve 22' comprises aperture 23' in combination with a strip 41 of plastic, rubber or the like. For example, if aperture 23' were about 3/16 inch in diameter, strip 41 could be about ¾ inch long and about ½ inch wide. That end of strip 41 remote from aperture 23' can be secured to bottle 10' by adhesive 42.

To fabricate the valve of FIG. 6 an elongated, tubular suction device can be used to pick up strip 41 to which adhesive 42 has been applied. After strip 41 has been inserted through the bottle mouth and pressed against bottle 10' in the position illustrated in FIG. 6, the vacuum is discontinued, and the suction device is removed.

It is noted that the strip of valve material such as strip 41 of FIG. 6 does not have to form a tight seal during assembly of the bottle. However, under pressure of a carbonated liquid, the strip and/or the adjacent portion of bottle 10 can deform to make a tight seal which prevents extrusion of the flexible bag. The term "tight seal" as used herein does not mean fluid or air tight, but rather, it means sufficient to prevent the flexible bag from extruding therethrough under pressure from a carbonated liquid.

Figure 7:
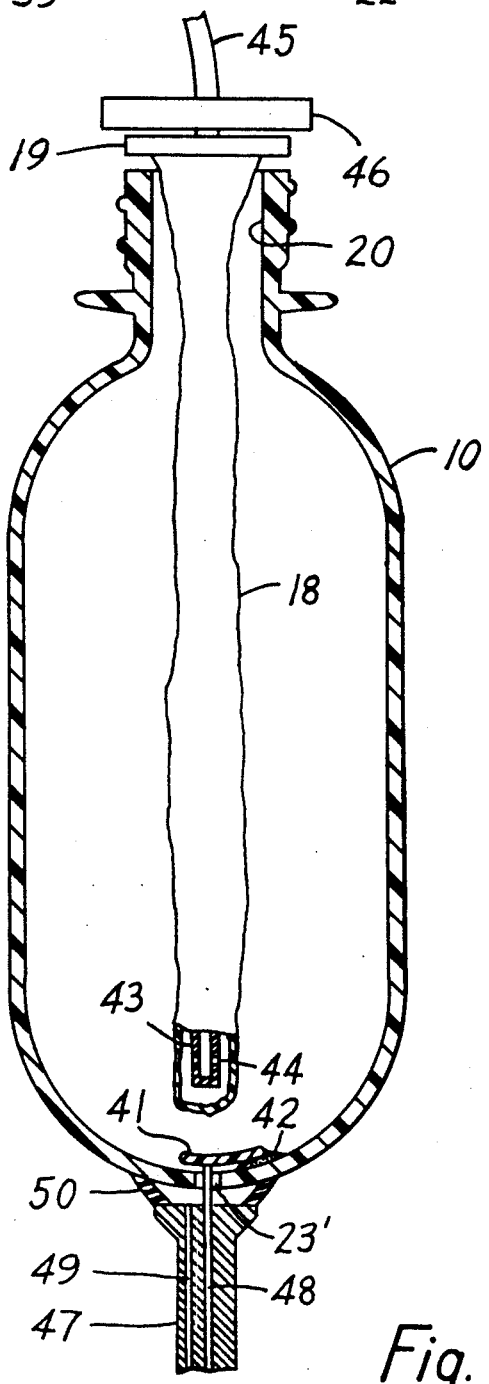
FIG. 7 is a cross-sectional view of a flexible bag insertion apparatus.

To insert a flexible bag into a bottle, it can be folded into an elongated mass of small cross-section whereby it can be slipped within the mouth 20 of bottle 10 (FIG. 2) and pushed down until the rim contacts the end of the bottle mouth. If desired, gas conducting means such as a tube 43 having one or more apertures 44 spaced longitudinally along the length thereof can be inserted through rim 19 and into bag 18 as shown in FIG. 7. A source of vacuum is connected by means of hose 45 to the tube 43 to evacuate air from bag 18 and collapse the same prior to insertion of the bag into bottle 10. A source of gas such as air is then supplied to tube 43 to blow up bag 18 and cause it to fill the entire space within bottle 10. The bottom surface of pressurizing connector 46 seals against rim 19.

The bottle in the bag insertion system of FIG. 7 is provided with an antiextrusion valve of the type illustrated in FIG. 6. However, the system of FIG. 7 also has utility with the valves of FIGS. 2 and 5. Since the pressure on the internal surface of strip 41 is relatively low during the process of expanding flexible bag 18, air that is trapped between bottle 10 and expanding bag 18 can leak under strip 41 and escape through aperture 23'. However, to facilitate the inflation of bag 18, an evacuation fixture 47 can be attached to the bottom of bottle 10. A rod 48 moves upwardly through fixture 47 and raises strip 41 above the inner surface of bottle 10 to permit the rapid evacuation of the bottle as bag 18 is filled with air. Removal of air from bottle 10 can be further assisted by providing fixture 47 with a vacuum passage 49 and a rubber seal 50.

The following sequence of steps is a preferred method of using the apparatus of FIG. 7. Tube 43 is inserted into bag 18, and the bag is evacuated so that it collapses onto tube 43 as shown in FIG. 7. The tube and bag are inserted into bottle 10, but a gap is allowed to remain between rim 19 and the end of mouth 20. The vacuum in tube 43 is released, and the tube is then supplied with sufficient pressure to expand bag 18 against bottle 10. Air from the bottle escapes through the gap under rim 19 and also leaks past strip 41 and through aperture 23'.

In another mode of operation evacuation fixture 47 is employed. Tube 43 is inserted into bag 18. The combination is inserted into bottle 10, and rim 19 is sealed to the end of mouth 20. Bottle 10 is evacuated through aperture 23' and vacuum passage 49. If necessary, rod 48 is inserted through aperture 23' to ensure that it is unobstructed. The vacuum on tube 43 is released, thereby causing the low pressure in bottle 10 to expand bag 18 by drawing air through hose 45 and tube 43. Either of these bag insertion methods could be employed for high-speed automated assembly of the container of the present invention.

The bottle can be placed under a filling machine where the fluid product is dispensed through rim 19 into bag 18. When cap 12 is affixed to the bottle, it squeezes rim 19 against the outer rim of mouth 27, thus forming an air-tight seal therebetween. If the pressure within bag 18 drastically increases (to a pressure which can be as high as 90 psi) due to rough handling of the bottle and/or increased temperature thereof, flexible bag 18 cannot be extruded through the bottle mouth because of the seal between rim 19 and the end of mouth 20. Furthermore, as the pressure within bag 18 exerts a downward force on thick region 24 (see FIG. 2), it seals against bottle 10 and prevents extrusion of bag 18 through aperture 23. Strip 39 of FIG. 5 and strip 41 of FIG. 6 similarly prevent extrusion of bag 18 through the valve aperture.

Figure 8:
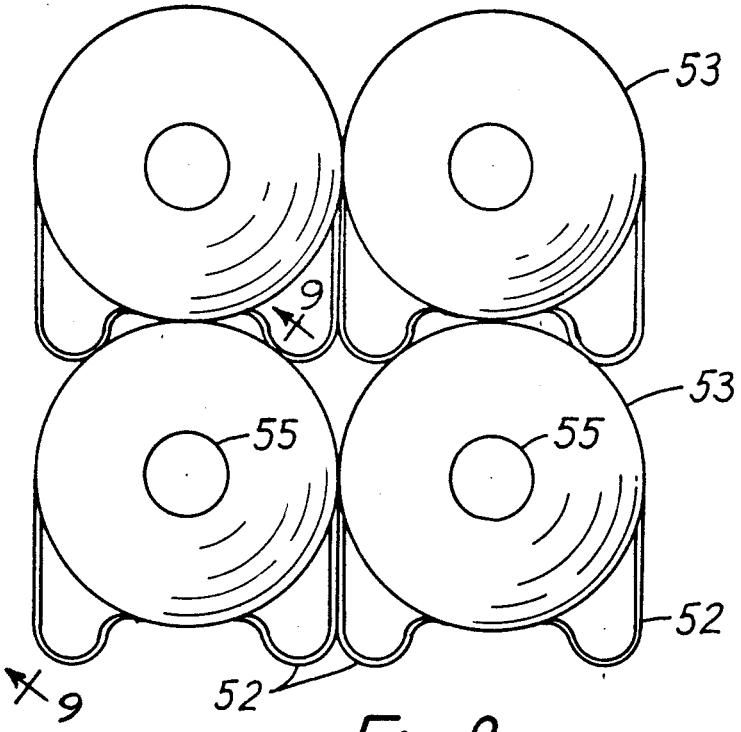
FIG. 8 is a plan view which illustrates the compact packing of a plurality of bottles having improved bases.
Figure 9:
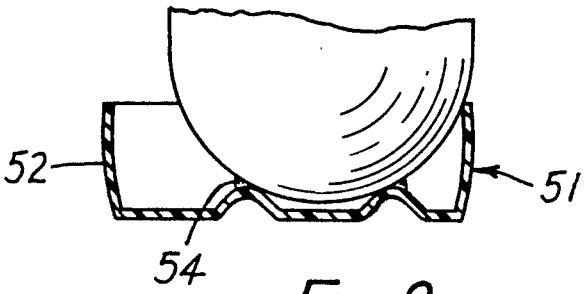
FIG. 9 is a cross-sectional view of the base of a bottle of the type shown in FIG. 8.

The bottle base can be constructed in the manner illustrated in FIGS. 8–10 to facilitate the dispensing of liquid from the bottle. Two feet 52 protrude from one side of base 51 in a direction perpendicular to the longitudinal axis of the bottle. Base 51 is secured to bottle 53 by adhesive 54.

The top view of FIG. 8, wherein bottles are provided with caps 55, illustrates that bottles having bases 51 can be relatively compactly packed for shipping or stacked for sale.

When it is desired to dispense liquid from bottle 53, cap 55 is replaced by any conventional dispensing means such as tap 57. Referring to FIG. 2, a tap would screw onto the convoluted threads of the bottle and draw rim 19 down onto the end of mouth 20 to maintain the air-tight seal at the bottle mouth. Bottle 53 is then placed at the edge of a surface such as tabletop 58 as shown in FIG. 10. Feet 52 lift the bottom of the bottle to facilitate draining of liquid therefrom.

We claim:

1. A receptacle for pressurized carbonated liquid, said receptacle comprising an outer container of substantially fixed shape formed with a mouth at one end thereof defining an opening into said outer container, an inner container for holding a fluid, said inner container being disposed within said outer container and being formed with a mouthpiece of substantially fixed shape defining an opening into said inner container, at least a portion of the mouthpiece of said inner container being disposed at the mouth of said outer container, at least a major portion of said inner container being collapsible, venting means located along said outer container at a region distal from said mouth for admitting air between said inner and outer containers to permit collapse of aid inner container when fluid is poured therefrom, said venting means comprising an aperture in the bottom of said outer container, and means for sealing said venting means when said carbonated liquid causes the pressure inside said inner and outer containers to exceed the pressure outside said outer container, thereby preventing extrusion of said inner container through said venting means when pressure builds up in said inner container, said means for preventing extrusion comprising a flexible cover over the inner surface of the bottom of said outer container, said cover contacting said outer container around the periphery of said aperture, an edge of said cover being adhered to said outer container at a region adjacent said aperture.

2. A receptacle comprising an outer container of substantially fixed shape formed with a mouth defining an opening into said outer container, said outer container having a longitudinal axis that passes through the mouth thereof, an inner container for holding a fluid, said inner container being disposed within said outer container and formed with a mouthpiece of substantially fixed shape defining an opening into said inner container, at least a portion of the mouthpiece of said inner container being disposed at the mouth of said outer container, at least a major portion of said inner container being collapsible, and base means affixed to that end of said outer container opposite said mouth, aid base means having at least one non-symmetrical projection extending laterally of said outer container to raise the bottom thereof when said outer container is disposed in a stable, horizontal fluid-dispensing position and to prevent said container from rotating about its longitudinal axis.

3. A receptacle in accordance with claim 2 wherein said base includes two spaced projections protruding from one side of said outer container, the distance between the outer portions of said projections being about the same as the outer diameter of said outer container, the minimum distance between said projections being sufficiently great that the outer container of an adjacent receptacle of the same diameter can fit between said projections and contact that portion of said outer container between said projections, whereby a plurality of said receptacles can be efficiently packed side-by-side.

4. A receptacle for pressurized carbonated liquid, said receptacle comprising an outer container of substantially fixed shape formed with a mouth at one end thereof defining an opening into said outer container, an inner container for holding a fluid, said inner container being disposed within said outer container and being formed with a mouthpiece of substantially fixed shape defining an opening into said inner container, at least a portion of the mouthpiece of said inner container being disposed at the mouth of said outer container, at least a major portion of said inner container being collapsible, venting means located along said outer container at a region distal from said mouth for admitting air between said inner and outer containers to permit collapse of said inner container when fluid is poured therefrom, said venting means comprising at least one aperture in the bottom of said outer container, and means for sealing said venting means when said carbonated liquid causes the pressure inside said inner and outer containers to exceed the pressure outside said outer container, thereby preventing extrusion of said inner container through said venting means when pressure builds up in said inner container, said means for sealing comprising a thickened wall on that end of said inner container opposite said mouthpiece, the remaining portion of said inner container other than aid thickened wall having a substantially uniform thickness, said thickened wall being sufficiently thick that it prevents extrusion of said inner container through said at least one aperture when said carbonated liquid causes the pressure inside said inner and outer containers to exceed the pressure outside said outer container.

5. A receptacle for pressurized carbonated liquid, said receptacle comprising an outer container of substantially fixed shape formed with a mouth at one end thereof defining an opening into said outer container, an inner container for holding a fluid, said inner container being disposed within said outer container and being formed with a mouthpiece of substantially fixed shape defining an opening into said inner container, at least a portion of the mouthpiece of said inner container being disposed at the mouth of said outer container, at least a major portion of said inner container being collapsible, venting means located along said outer container at a region distal from said mouth for admitting air between said inner and outer containers to permit collapse of said inner container when fluid is poured therefrom, said venting means comprising at least one aperture in the bottom of said outer container, and means for sealing said venting means when said carbonated liquid causes the pressure inside said inner and outer containers to exceed the pressure outside said outer container, thereby preventing extrusion of said inner container through said venting means when pressure builds up in said inner container, said means for sealing comprising a layer of flexible material adhered to said inner container on the end of said inner container opposite said mouthpiece, the remaining portion of said dinner container, other than that portion thereof to which said layer of flexible material is adhered, having a substantially uniform thickness, the combined thickness of said inner container and said layer of flexible material being sufficiently great that said inner container is prevented from extruding through said at least one aperture when said carbonated liquid causes the pressure inside said inner and outer containers to exceed the pressure outside said outer container.

6. A receptacle for pressurized carbonated liquid, said receptacle comprising an outer container of substantially fixed shape formed with a mouth at one end thereof defining an opening into said outer container, an inner container for holding a fluid, said inner container being disposed within said outer container and being formed with a mouthpiece of substantially fixed shape defining an opening into said inner container, at least a portion of the mouthpiece of said inner container being disposed at the mouth of said outer container, at least a major portion of said inner container being collapsible, venting means located along said outer container at a region distal from said mouth for admitting air between said inner and outer containers to permit collapse of said inner container when fluid is poured therefrom, means for sealing said venting means when said carbonated liquid causes the pressure inside said inner and outer containers to exceed the pressure outside said outer container, thereby preventing extrusion of said inner container through said venting means when pressure builds up in said inner container, and a base affixed to that end of said outer container opposite said mouth, said base having at least one non-symmetrical projection extending laterally of said outer container to raise the bottom thereof when said container is disposed in a stable, horizontal, fluid-dispensing position.

7. A receptacle for pressurized carbonated liquid, said receptacle comprising an outer container of substantially fixed shape formed with a mouth at one end thereof defining an opening into said outer container, an inner container for holding a fluid, said inner container being disposed within said outer container and being formed with a mouthpiece of substantially fixed shape defining an opening into said inner container, at least a portion of the mouthpiece of said inner container being disposed at the mouth of said outer container, at least a major portion of said inner container being collapsible, venting means located along said outer container at a region distal from said mouth for admitting air between said inner and outer containers to permit collapse of said inner container when fluid is poured therefrom, and means for sealing said venting means when said carbonated liquid causes the pressure inside said inner and outer containers to exceed the pressure outside said outer container, thereby preventing extrusion of said inner container through said venting means when pressure builds up in said inner container, said means for sealing comprising a thickened wall on that region of said inner container adjacent said venting means.

* * * * *